US007083309B2

(12) United States Patent
Chan et al.

(10) Patent No.: US 7,083,309 B2
(45) Date of Patent: Aug. 1, 2006

(54) FLUORESCENT LAMP TUBE HAVING INTEGRATED ELECTRONIC BALLAST

(76) Inventors: Kam Kwan Chan, 20 Catchick Street, Hong Kong (HK); Wai Kuen Ng, 20 Catchick Street, Hong Kong (HK)

( * ) Notice: Subject to any disclaimer, the term of this patent is extended or adjusted under 35 U.S.C. 154(b) by 0 days.

(21) Appl. No.: 10/498,629

(22) PCT Filed: Jul. 28, 2003

(86) PCT No.: PCT/CN03/00602

§ 371 (c)(1),
(2), (4) Date: Jun. 14, 2004

(87) PCT Pub. No.: WO2004/019369

PCT Pub. Date: Mar. 4, 2004

(65) Prior Publication Data

US 2005/0067977 A1 Mar. 31, 2005

(30) Foreign Application Priority Data

Aug. 23, 2002 (HK) ..... 02106223.4

(51) Int. Cl.
*F21V 21/10* (2006.01)
*H01J 5/00* (2006.01)

(52) U.S. Cl. ..... 362/429; 362/435; 362/437; 362/378; 313/317; 313/573; 313/312

(58) Field of Classification Search ..... 362/178, 362/171, 260, 378, 353, 377; 313/573, 623–636, 313/249, 251; 315/56–50, 200 A, 209 R, 315/224

See application file for complete search history.

(56) References Cited

U.S. PATENT DOCUMENTS 4,092,706 A 5/1978 Vest ..... 362/390

(Continued)

FOREIGN PATENT DOCUMENTS

CN 2034332 U 3/1989

(Continued)

OTHER PUBLICATIONS

Copy of the International Search Report from PCT/CN03/00602 dated Sep. 18, 2003.

(Continued)

*Primary Examiner*—Tuyet Thi Vo
(74) *Attorney, Agent, or Firm*—David J. Dykeman; Edwards Angell Palmer & Dodge LLP

(57) ABSTRACT

A new fluorescent lamp comprises a lamp tube and an electronic ballast, it is characterized in that it is provided with an outer tube, there are respectively an outer plug at both ends of the outer tube, in which inserts a socket for the lamp tube. The electronic ballast is between the outer plug and the socket for the lamp tube at one end, said lamp tube is disposed between two sockets for the lamp tube. There are advantages as follows: an urgent lighting, the electronic ballast and the compact lamp tube are integrated as one whole; it is convenient for mounting and exchanging, a cost for mounting is greatly reduced; it is possible for repacking to maintain an original means, to reduce a contamination of waste; its weight is light; its power factor is high, more than 95%, it is economical in power, a cost for transporting is low; the color rendering index (CRI) is more than 80%; it is ignited immediately after it is turned on, it does not flash; it is applied to lamps having deferent power; the life of the lamp tube is prolonged by 50%; its output brightness is higher than existing lamps by twice or more; the lamp tube still steadily operates when a power supply is unexpected to be shut off, which reduces accident cases; the whole distortion of a resonant wave becomes smaller than 30%.

5 Claims, 3 Drawing Sheets

U.S. PATENT DOCUMENTS

| | | | | |
|---|---|---|---|---|
| 4,163,176 | A * | 7/1979 | Cohen et al. | 315/53 |
| 5,130,605 | A | 7/1992 | Ogawa et al. | 315/105 |
| 5,489,813 | A * | 2/1996 | Jung | 313/25 |
| 5,716,128 | A * | 2/1998 | Clark et al. | 362/221 |
| 5,848,836 | A * | 12/1998 | Graber et al. | 362/223 |
| 6,169,373 | B1 * | 1/2001 | Riesinger | 315/200 A |
| 6,558,020 | B1 * | 5/2003 | Holzer | 362/221 |
| 6,624,554 | B1 * | 9/2003 | Holzer | 313/318.01 |
| 2002/0011790 | A1 * | 1/2002 | Holzer | 315/56 |
| 2005/0030750 | A1 * | 2/2005 | Ehmen et al. | 362/260 |

FOREIGN PATENT DOCUMENTS

| | | | |
|---|---|---|---|
| DE | 19512307 | A1 | 4/1995 |
| EP | 0274107 | A2 | 12/1987 |
| EP | 0274107 | A3 | 12/1987 |
| WO | WO 96/31996 | | 10/1996 |

OTHER PUBLICATIONS

Supplemental European Search Report based on EP 03792093 dated Sep. 21, 2005.

* cited by examiner

FLUORESCENT LAMP TUBE HAVING INTEGRATED ELECTRONIC BALLAST

RELATED APPLICATIONS

This application is a National Phase of PCT/CN2003/000602, filed Jul. 28, 2003, which claims priority to CN02106223.4, filed Aug. 23, 2002, the entireties of are hereby incorporated by reference.

FIELD OF INVENTION

The present invention relates to a fluorescent lamp tube.

BACKGROUND OF INVENTION

Currently, the widely used fluorescent lamp is comprised of a lamp tube, a ballast, a starter, and a metal bracket for supporting these parts. Most of the existing ballasts are inductive. This kind of fluorescent lamp has the following defects: (1) it has a high electricity consumption; (2) it makes noises when the ballast works; (3) the replacement procedure of ballast is complex and the labor cost of said replacement is high; (4) the power factor and the intensity of illumination of the fluorescent lamp are low; (5) the lightpipe flashes when starting; (6) the lightpipe cannot remain bright when the power is cut off; (7) when the starter is worn out, the common lightpipe cannot be started as well; (8) the inductive ballast is made of iron and copper, and thus not environment-friendly; (9) the metal bracket plus inductive ballast is over heavy; (10) the harmonic distortion is so high that it seriously pollutes the power source.

The Government of the Hong Kong Special Administrative Region of China, on Jul. 1, 2000, together with two electric power companies, China Light & Power Group and the Hong Kong Electric Group, put forward a plan, named as "Management For The Demand Of Electric Power", to help small-and-medium sized enterprises to replace the old inductive ballast and old lightpipe with electricity-saving ballast and electricity-saving lightpipe in the form of subsidies. Continuously promoted by the related companies for a period of time, its evolution is still relatively slow. The main reasons are that, the cost needed for said replacement is too large for many enterprises, and a large number of metal brackets and ballasts after the replacement will render environmental problems.

SUMMARY OF INVENTION

The objective of the present invention is to overcome the above-mentioned shortcomings in the prior art by providing a novel, low-cost and simply replaced fluorescent lamp tube.

The objective of this invention is realized through the following technical solutions.

A novel fluorescent lamp tube comprises a lamp tube, an electronic ballast, and an outer tube with the two ends fixed with outer plugs of lamp tube sockets, wherein the electronic ballast is equipped between one of said outer plugs and the respective lamp tube socket, and said lamp tube is located between the two lamp tube sockets in said outer tube.

Besides the above-mentioned indispensable technical features, the following technical content can be supplemented during the procedure of implementing: The lamp tube is power-saving with a small diameter; The outer plugs are those at the two ends of an ordinary fluorescent lamp; The electronic ballast is comprised of a rectifier and a high frequency inverter, wherein the input of said rectifier, connected to an external power supply, inverts alternating current (AC) into direct current (DC) with the needed voltage, and its output is connected to the high frequency inverter, which inverts direct current (DC) into high frequency alternating current (AC) as the power supply for said lamp tube. A bracket for installing batteries is equipped between the lamp tube socket without electronic ballast and the respective outer plug, in which several batteries are installed, and said batteries are electrically connected to the rectifying output of said electronic ballast.

This utility model has the advantages as follows:

1. Emergent illumination, electronic ballast and power-saving lightpipe are integrated, which results in convenient installation and replacement, and a significant decrease in the cost on installation;
2. It has a high power factor of more than 95%, and thus is electricity-saving and low in operational cost;
3. Color Rendering Index (CRI) is more than 80%;
4. It will illuminate as soon as being turned on, without flashing;
5. It is adaptive to lamp tubes of different power;
6. The using-life of lamp tube is prolonged by 50%;
7. The output luminosity is more than three times of the old lightpipe;
8. It can be used as a portable torch;
9. It will still work stably when the power is cut off accidentally, and thus can decrease accidents;
10. The refitment can remain the original equipment, and thus can decrease pollution;
11. It is light weight;
12. The total harmonic distortion (THD) is less than 30%.

BRIEF DESCRIPTION OF THE DRAWINGS

To further understand the structure, features and functions of this invention, the following embodiments are provided and described in detail in conjunction with the accompanying drawings in which.

DETAILED DESCRIPTION

Figure 1:
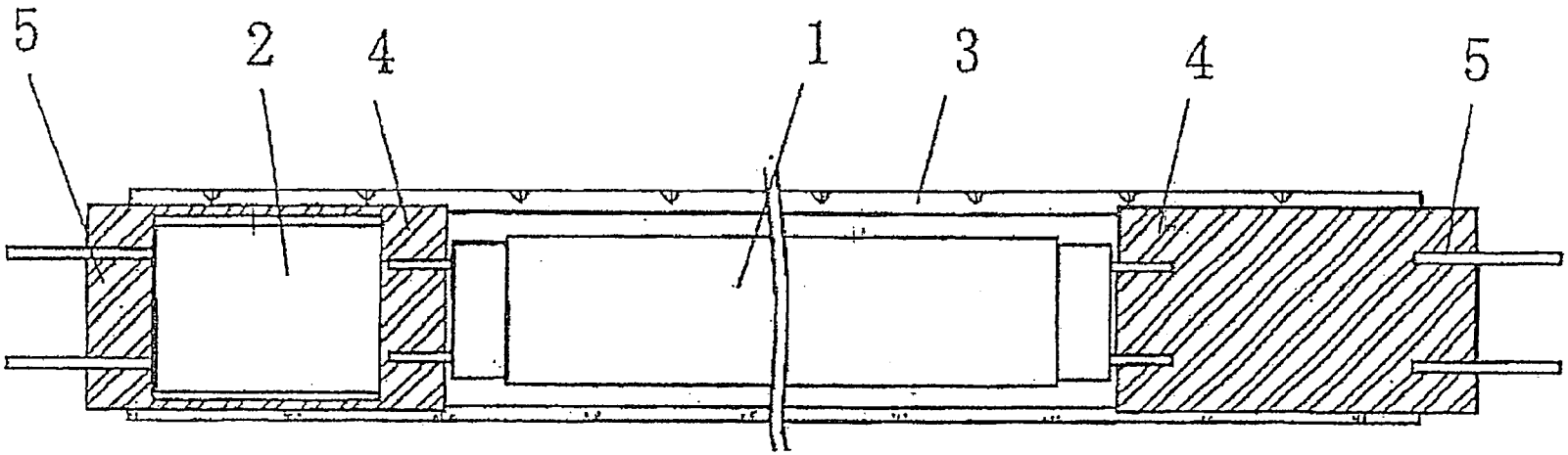
FIG. 1 is a sectional view of an embodiment according to the invention.

As shown in FIG. 1, the novel fluorescent lamp tube as provided in this utility model comprises a lamp tube 1, an electronic ballast 2, and an outer tube 3 made of transparent materials (such as glass or transparent plastic), the two ends of which are fixed with outer plugs 5 of lamp tube sockets 4, wherein an electronic ballast 2 is equipped between one of said outer plugs 5 and the respective lamp tube socket 4. The lamp tube 1 is located between the two lamp tube sockets 4 in the outer tube 3. The lamp tube can be a power-saving one with a small diameter, and the outer plugs 5 are those at the two ends of an ordinary fluorescent lamp. These parts thereby form a novel power-saving fluorescent lamp tube capable of being directly equipped on the supporting bracket of a prior fluorescent lamp, and the electronic ballast is equipped in the fluorescent lamp tube, unnecessary to install another one. Therefore, the cost needed for said replacement will be decreased.

Figure 2:
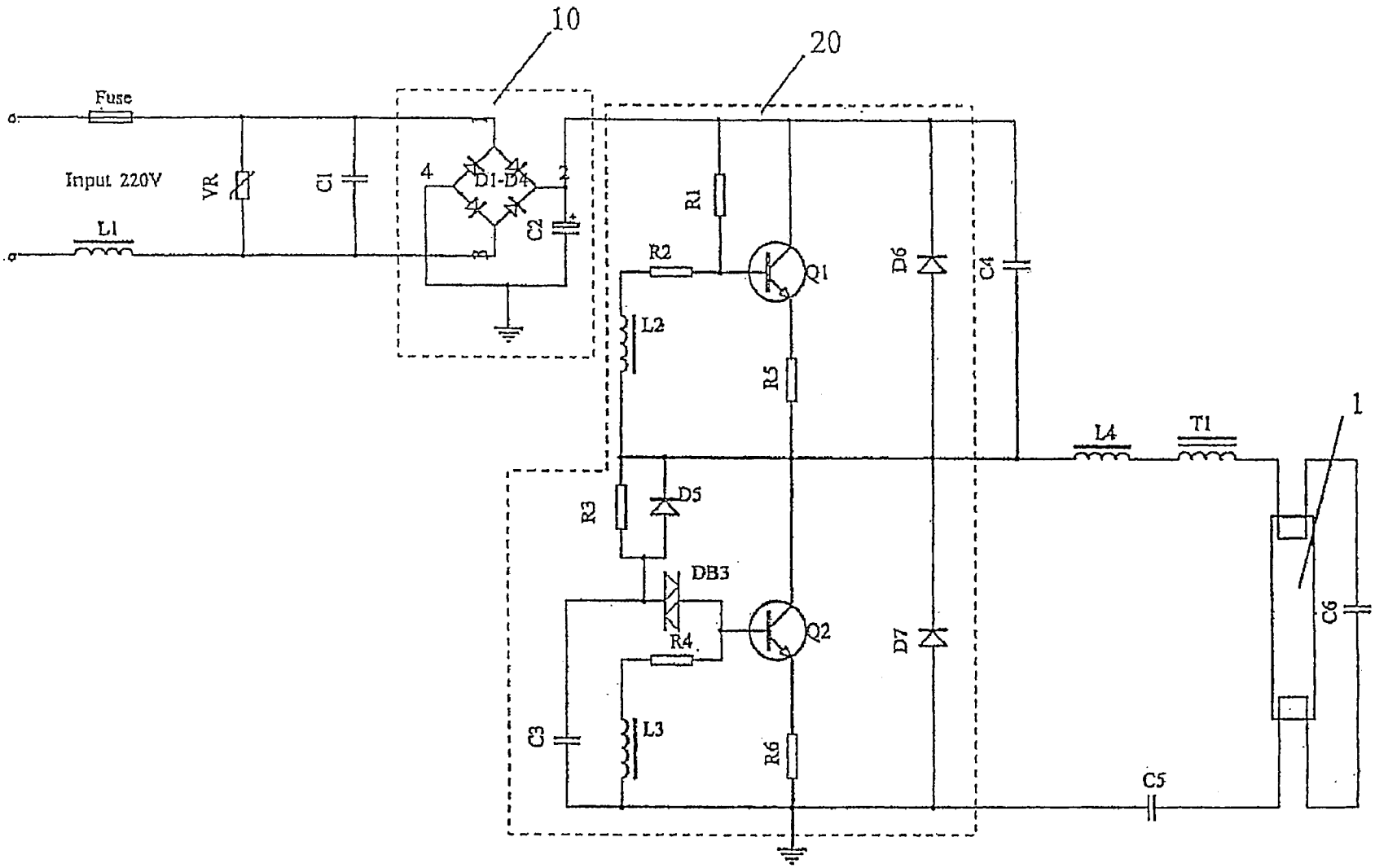
FIG. 2 is a circuit diagram of the electronic ballast of the invention.

FIG. 2 is a circuit diagram of the electronic ballast, which is constituted of a rectifier 10 and a high frequency inverter 20, wherein the input of said rectifier 10, connected to an external power supply, inverts alternating current (AC) into direct current (DC) with the needed voltage, and its output is connected to the high frequency inverter 20, which inverts direct current (DC) into high frequency alternating current (AC) as the power supply for said lamp tube.

As for this novel fluorescent lamp tube of the utility model, the outer plugs 5, equipped at its two ends, are those at the ends of an ordinary fluorescent lamp, which have four pins, practically with any two pins connected to the external power supply. The purpose of the four pins is to directly install said lamp tube onto the supporting bracket of the prior fluorescent lamp. On the concrete product, the two pins should be marked out, so as to be connected to the external power supply.

Figure 3:
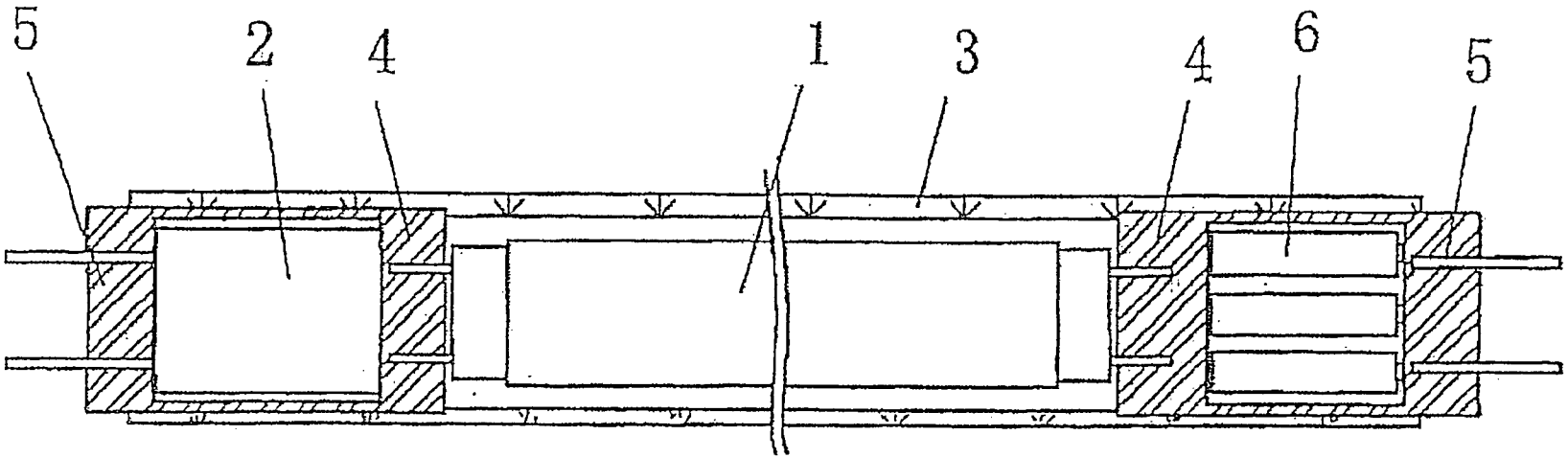
FIG. 3 is a sectional view of another embodiment according to the invention.

A bracket for installing batteries is equipped between the lamp tube socket without the electronic ballast and the respective outer plug (as shown in FIG. 3), in which several batteries 6 are installed, and said batteries are electrically connected to the rectifying output of said electronic ballast, so as to work stably when the power supply is cut off accidentally, to decrease accidents, and to be used as a portable torch.

We claim:

1. A fluorescent lamp tube comprising: a lamp tube, an integrated electronic ballast, and an outer tube having two ends with outer plugs for respectively plugging into two lamp tube sockets, wherein said integrated electronic ballast is between one of said outer plugs and the respective lamp tube socket, and said lamp tube is located between the two lamp tube sockets in said outer tube.

2. The fluorescent lamp tube according to claim 1, wherein said lamp tube is a power-saving lamp tube with a small diameter.

3. The fluorescent lamp tube according to claim 1, wherein said outer plugs are outer plugs at two ends of an ordinary fluorescent lamp.

4. The fluorescent lamp tube according to claim 1, wherein said electronic ballast includes a rectifier and a high frequency inverter, wherein an input of said rectifier is connected to an external power supply, the rectifier inverts alternating current (AC) into direct current (DC) with a needed voltage, and an output of said rectifier is connected to the high frequency inverter, which inverts direct current (DC) into high frequency alternating current (AC) for supplying electrical power to said lamp tube.

5. The fluorescent lamp tube according to claim 1, further comprising a battery bracket between one of said lamp tube sockets which is remote to the electronic ballast and the respective outer plug, a plurality of batteries installed in the battery bracket, said batteries electrically connected to a rectifying output of said electronic ballast.

* * * * *